US006722470B2

(12) United States Patent
Carson

(10) Patent No.: US 6,722,470 B2
(45) Date of Patent: Apr. 20, 2004

(54) ANCHORAGE ADAPTER, SYSTEMS AND METHODS FOR USE IN FALL PROTECTION

(75) Inventor: Jeffrey C. Carson, Franklin, PA (US)

(73) Assignee: Bacou-Dalloz Fall Protection Investment, Inc., Wilmington, DE (US)

( * ) Notice: Subject to any disclaimer, the term of this patent is extended or adjusted under 35 U.S.C. 154(b) by 0 days.

(21) Appl. No.: 10/081,261

(22) Filed: Feb. 22, 2002

(65) Prior Publication Data

US 2003/0159883 A1 Aug. 28, 2003

(51) Int. Cl.[7] ..... A47L 3/02; E06C 7/18

(52) U.S. Cl. ..... 182/113; 182/106; 248/228.1; 52/736.1

(58) Field of Search ..... 248/125.2, 228.1, 248/228.3, 228.5, 228.6, 229.1, 229.15, 229.12, 231.41, 231.61, 231.71, 316.4, 316.6; 182/3, 36, 45, 106, 113; 52/DIG. 12, 27, 125.4, 127.1, 127.2, 736.1; 256/DIG. 6, 59, 65, 67

(56) References Cited

U.S. PATENT DOCUMENTS 3,217,833 A * 11/1965 Smith ..... 182/3
3,920,221 A * 11/1975 Berry et al. ..... 256/59
3,938,619 A * 2/1976 Kurabayashi et al. ..... 182/113
4,037,824 A * 7/1977 Whitmer ..... 256/59 X
5,029,670 A * 7/1991 Whtimer ..... 182/113
5,307,897 A * 5/1994 Turner et al. ..... 182/3
5,353,891 A * 10/1994 Griek et al. ..... 182/45
5,711,397 A * 1/1998 Flora et al. ..... 182/3
5,730,245 A * 3/1998 Conway ..... 182/3
5,782,043 A * 7/1998 Duncan et al. ..... 52/167.1
5,863,020 A * 1/1999 Olson et al. ..... 248/228.3
6,036,146 A * 3/2000 Paterson ..... 182/113 X
6,053,279 A * 4/2000 McKenna ..... 182/36
6,412,598 B1 * 7/2002 Mackinnon ..... 182/3
6,439,344 B1 * 8/2002 Cole ..... 182/113
6,478,111 B2 * 11/2002 Olson et al. ..... 182/3
6,502,663 B2 * 1/2003 Ecker et al. ..... 182/3

* cited by examiner

*Primary Examiner*—Hugh B. Thompson, II
(74) *Attorney, Agent, or Firm*—Bartony & Hare, LLP

(57) ABSTRACT

A system for anchoring a lifeline includes a support member for the lifeline. The support member includes a first connector to attach the support member to a first type of anchorage. The system preferably further includes at least one adapter having a second connector to attach the adapter to a second type of anchorage. The adapter includes an anchorage of the first type to which the support member can be attached.

19 Claims, 6 Drawing Sheets

ANCHORAGE ADAPTER, SYSTEMS AND METHODS FOR USE IN FALL PROTECTION

BACKGROUND OF THE INVENTION

The present invention relates to an anchorage adapters, systems and methods for use in fall protection, and, more particularly, to anchorage adapters, systems and method for use by personnel working at a height in a wide variety of settings in which anchorages of differing types are present.

Fall protection systems including safety harnesses and lanyards are commonly used as parts of fall protection systems for persons subjected to the potential of a fall from a height. Typically, a lifeline or lanyard is connected to an overhead anchorage. However, in some cases (for example, steel building erection, bridge work, pipe rack erection and maintenance, leading edge work, etc.) suitable overhead fall protection anchorage may not exist.

In cases in which no suitable overhead anchorage is available, it is typically necessary to create anchorage for fall protection. For example, the DELTA FORCE™ temporary horizontal lifeline system 10 available from Dalloz Fall Protection of Franklin, Pa. is illustrated in FIGS. 1 and 2. Horizontal lifeline system 10 includes stanchions 20 that attach to an upper flange 110 of, for example, a steel beam such as an I-beam 100. Several stanchions 20 are attached to beam 100 and are spanned by a horizontal lifeline 200 to which a person's lanyard can be attached.

Although flanged beams such as I-beam 100 are used throughout the construction industry, it is desirable to develop an anchorage system that can be used in a wide variety of settings, even when flanged beams are unavailable.

SUMMARY OF THE INVENTION

In one aspect, the present invention provides a system for anchoring a lifeline for use in fall protection including a support member for the lifeline. The support member includes a first connector to attach the support member to a first type of anchorage. The system preferably further includes at least one adapter having a second connector to attach the adapter to a second type of anchorage. The adapter includes an anchorage of the first type to which the support member can be attached.

The first connector can, for example, attach to a flange of flanged beam such as an I-beam. The first connector can attach to opposing sides of the flange. In one embodiment, the first connector includes at least one clamp to attach to a first side of the flange and an extending member to clasp or attach to a second, opposing side of the flange.

The second connector of the adapter can, for example, attach to reinforcement bar in concrete. In one embodiment, the second connector includes at least one bracket to fasten to a reinforcement bar. Preferably, the second connector includes a plurality of brackets, each of which fastens to a reinforcement bar.

The adapter can further includes at least one adapter flange to which the first connector of the support member is attachable. In one embodiment, the adapter includes a first adapter flange extending from a generally vertical member in a first direction and a second adapter flange extending from the generally vertical member in a second direction generally opposite from the first direction. The first connector attaches to the first and second adapters flanges as described above. The adapter can also include at least a third adapter flange extending from the generally vertical member at an end of the generally vertical member opposite of the first and second adapter flanges. In one embodiment, the adapter includes a fourth flange extending from the generally vertical member in a direction generally opposite of the third flange. The third and/or fourth flanges can operate to stabilize the adapter when attached to a concrete beam from which reinforcement bars extend.

In another aspect, the present invention provides a system for anchoring a fall protection horizontal lifeline including a plurality of support members for the lifeline. Each of the support members includes a first connector to attach the support member to a first type of anchorage. The system further includes at least one adapter for each support member. The adapter includes a second connector to attach the adapter to a second type of anchorage as described above. The adapter also includes an anchorage of the first type to which the support member can be attached.

In a further aspect, the present invention provides a system for anchoring a fall protection horizontal lifeline including a plurality of support members for the lifeline. Each of the support members includes a first connector to attach the support member to an I-beam. The system further includes at least one adapter for each support member. The adapter including a second connector to attach the adapter to concrete reinforcement bar. The adapter also includes an anchorage to which the first connector can be attached.

In another aspect, the present invention provides an adapter for attaching or anchoring a support member for anchoring a fall protection lifeline. The support member includes a first connector to attach the support member to an I-beam as described above. The adapter includes a second connector to attach the adapter to concrete reinforcement bar and at least one flange to which the first connector can be attached.

In still another aspect, the present invention provides a method of anchoring a fall protection lifeline to different types of anchorage. The method includes the steps: providing a support member for the lifeline including a first connector to attach the support member to a first type of anchorage; and providing at least one adapter including a second connector to attach the adapter to a second type of anchorage, the adapter including an anchorage of the first type to which the support member can be attached.

The adapters, systems and methods of the present invention greatly increase the number of environments or settings in which fall protection anchorage supports can be used. In general, a lifeline support is provided which is attachable to one type of anchorage. A common type of anchorage is a flanged I-beam. One or more adapters of the present invention can then be used to attach the support to anchorages of different types (for example, to a concrete beam reinforced by rebar). A plurality of such adapters can be provided to connect the support to a plurality of anchorage types. Such adapters can be used singly or in combination to extend the environments in which the lifeline support is usable.

DETAILED DESCRIPTION OF THE INVENTION

Figure 1B:
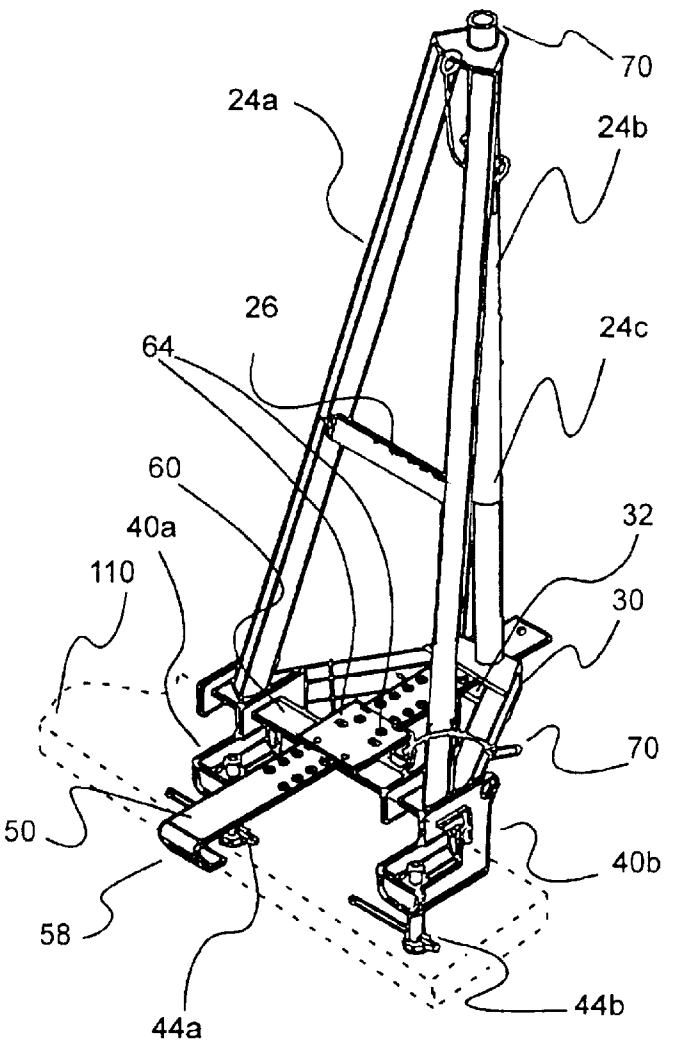
PRIOR ART FIGURE 1B
FIG. 1B illustrates a perspective view of the stanchion of FIG. 1A mounted on the flange of a beam (illustrated with dashed lines).

In one aspect, the present invention provides an anchorage system 300 as illustrated in FIGS. 3 through 6B. In the embodiment of FIGS. 3 through 6B, anchorage system 400 includes one or more stanchions 20. Stanchions 20 include an upper section including three extending members or bars 24*a*, 24*b* and 24*c* arranged generally as a tripod. Extending members 24*a* and 24*b* are connected via a crossbar member 26. The lower ends of extending members 24*a*, 24*b* and 24*c* are attached to a lower base 30. Base 30 includes clamps 40*a* and 40*b* and cooperating clamping bolts 44*a*and 44*b* that grip a first edge of flange 110 as illustrated in FIGS. 1B and 2.

Stanchions 20 also include an extension bar 50 that abuts a second edge of flange 110 via, for example, a hook-shaped abutment or clamping member 58 on an end of extension bar 50 to securely mount stanchion 20 to I-beam 100. As illustrated, for example, in FIG. 1B, extension bar 50 slides under a cross member 60 of base 30 and through an opening or slot 32 formed by base 30. A mount 62 having holes 64 that are alignable with holes 54 in extension bar 50 is used to lock extension bar 50 in a desired position using lock pin 70. Clamps 40*a* and 40*b* cooperate with extension bar 50 to securely clamp stanchion 20 to flange 110 of I-beam 100.

Figure 2:
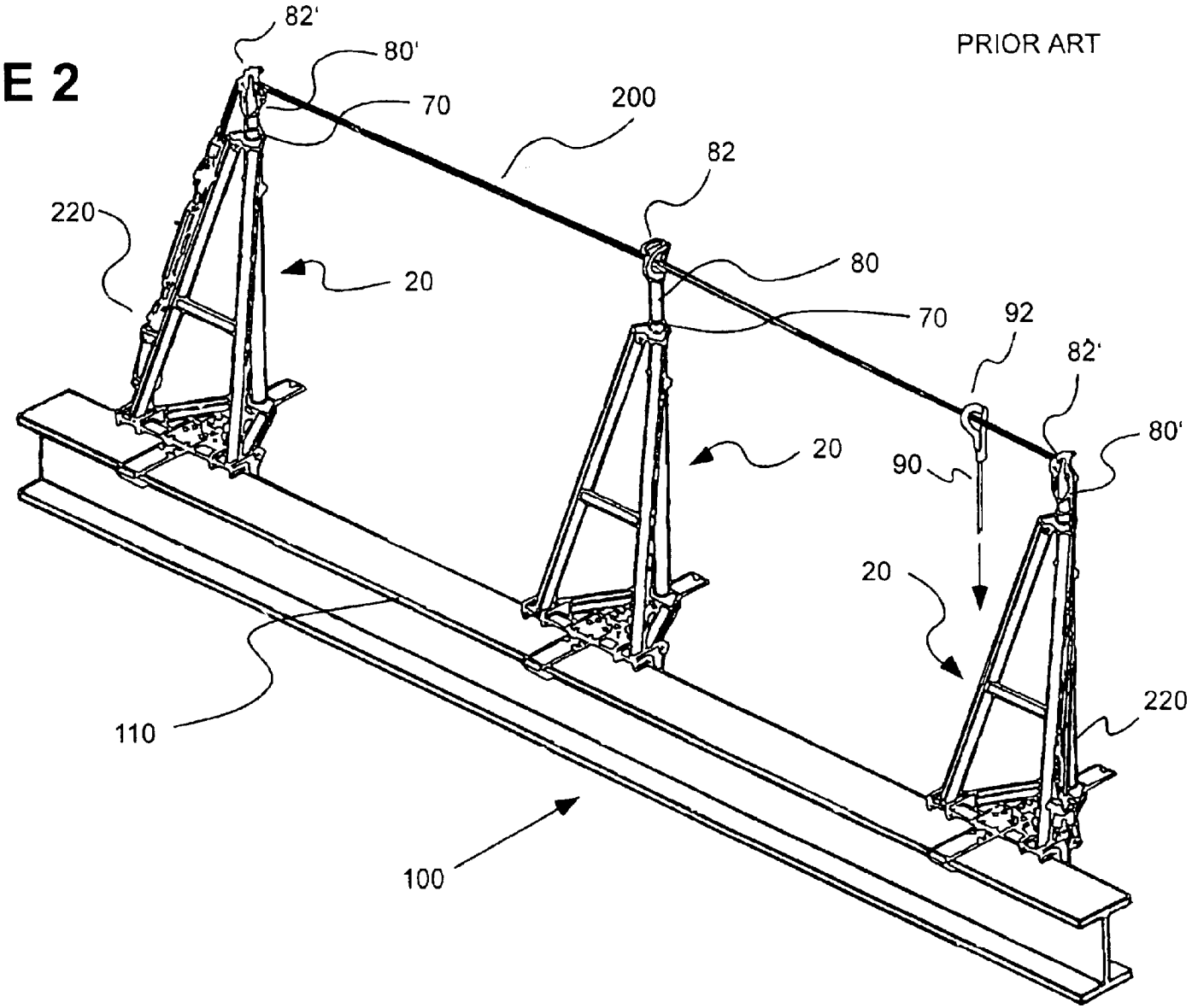
FIG. 2 illustrates a perspective view of several of the stanchions of FIG. 1 attached to an I-beam.

As illustrated in FIG. 2, several stanchions 20 can be attached to I-beam flange 110 to support a horizontal lifeline 200. In that regard, intermediated stanchion 20 includes and intermediate head member 80, and end stanchions 20 include and head members 80'. Head members 80 or 80' seat in seating 70 of stanchion 20. Head members 80 and 80' included brackets 82 and 82', respectively, through which horizontal lifeline 200 passes. One or more shock absorbers 220 can be provided as known in the art.

A load (for example, a person) represented by a downward arrow in FIG. 2 can be attached to horizontal lifeline 200 via lifeline 90, which is attached to horizontal lifeline 200 via a snap hook 92 as known in the art. Lifeline 90 can support a person via cooperation with a safety harness worn by the person such as disclosed in U.S. Pat. No. 6,006,700, the disclosure of which is incorporated herein by reference. As illustrated in, for example, FIG. 2, stanchions 20, via extending members 24*a*, 24*b* and 24*c*, support horizontal lifeline 200 at a position extended a distance away from I-beam 100 to allow a worker attached to lifeline 90 generally free horizontal movement along horizontal lifeline 200.

Stanchions 20 work very well in all cases in which a flanged beam is available to which to secure stanchions 20. The use of stanchions 20 in connection with flanged beams is described in detain in the "Operation and Maintenance Manual for the Miller Delta Force Temporary Horizontal Lifeline" (2000) available from Dalloz Fall Protection of Franklin, Pa., the disclosure of which is incorporated herein by reference. However, in many instances in, for example, the construction industry a flanged beam such as I-beam 100 may not be available to support stanchions 20. For example, concrete beams reinforced with steel reinforcement bars (sometimes referred to as rebar) are present on many constructions site. Stanchion 20 cannot be attached to such reinforced concrete beams.

Figure 1A:
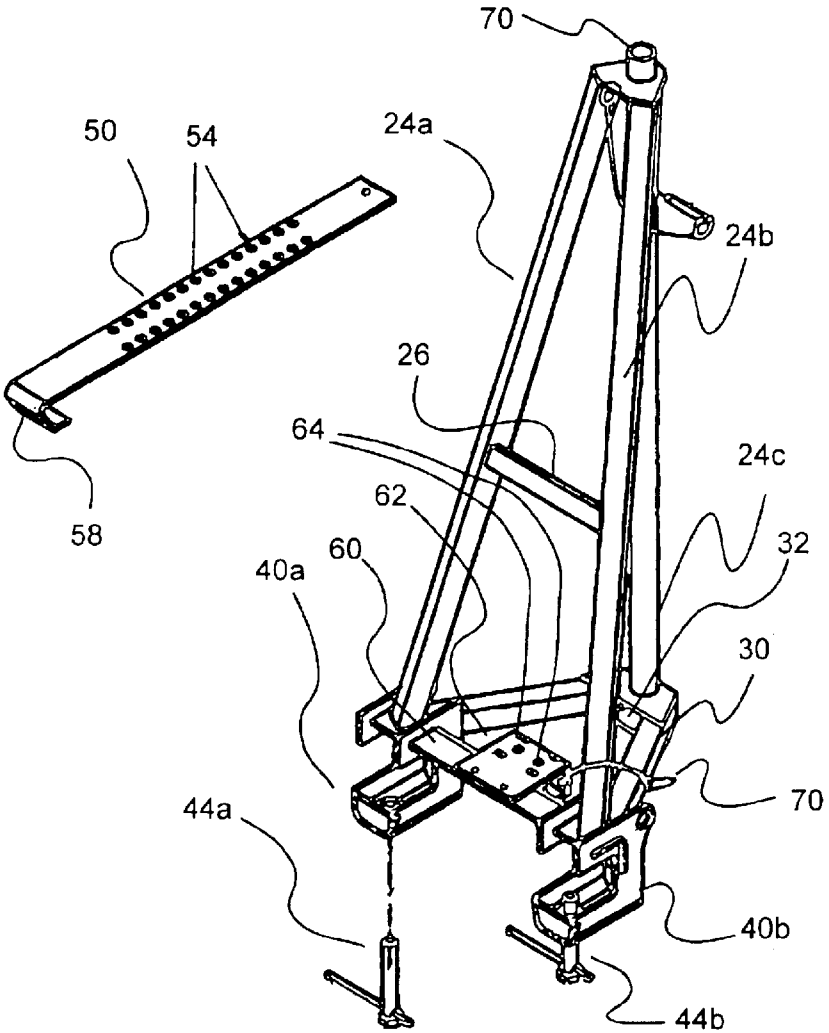
PRIOR ART FIGURE 1A
FIG. 1A illustrates a perspective view of a commercially available stanchion for a temporary horizontal lifeline system in a partially disassembled state.
Figure 3:
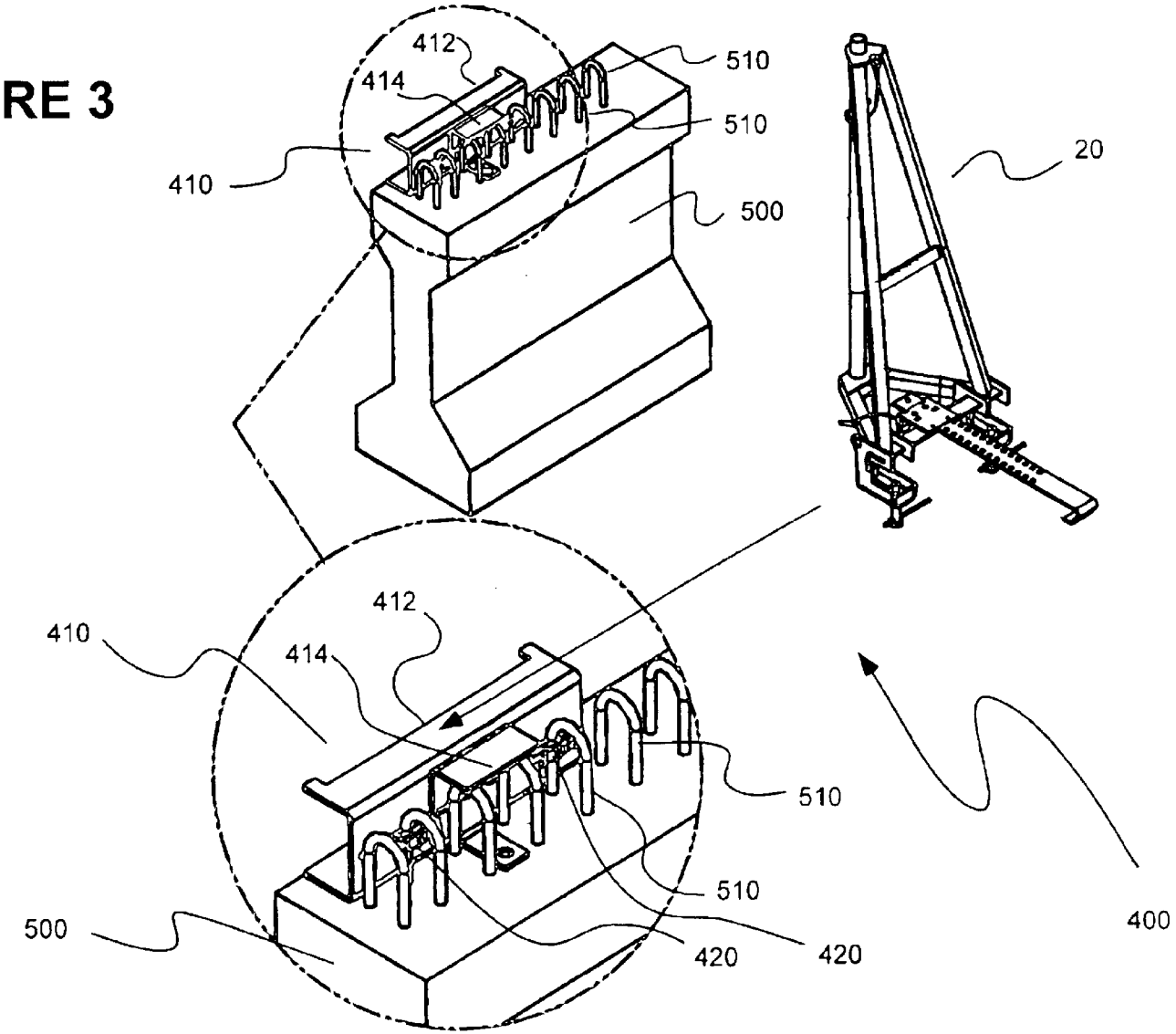
FIG. 3 illustrates a perspective view of an adapter attached to a rebar system on a concrete beam to adapt the horizontal lifeline system of FIGS. 1 and 2 for use the reinforced concrete beam.

FIGS. 3-6 illustrate a system 400 of the present invention in which stanchions 20 are adapted for use with a number or anchorage elements other than flanged beams. In FIG. 3 a steel reinforced concrete beam 500 is illustrated with steel rebars 510 exiting the concrete on a top surface of beam 500. As is common in the construction industry, rebars 510 form loops and reenter concrete beam 500. The stanchion system of FIGS. 1 and 2 cannot be attached to steel reinforced concrete beam 500. In system 400, an adapter 410 is used to attach stanchions 20 to concrete beam 500.

Adapter 410 includes at least one attachment member to attach adapter 410 to an anchorage other than a flanged beam such as I-beam 110. In the embodiment of FIGS. 3 through 6, the attachment mechanism includes two attachment members such as clips, clamps or brackets 420 that attach to looped rebars 510. Adapter 410 includes a front upper flange 412 and rear upper flange 414 that together provide an attachment flange similar in overall structure and operation to flange 110 of I-beam 100. Adapter 410 also includes a front lower flange 416 and a rear lower flange 418, which increase the stability of adapter 410 on beam concrete beam 500. Upper flanges 412 and 414 and lower flanges 416 and 418 extend from and are connected by a generally vertical member 430. In the embodiment of FIGS. 3 through 6, lower flange 418 is preferably sufficiently narrow to pass between rebars 510 to suitably position adapter 410 on reinforce concrete 500.

Figure 4:
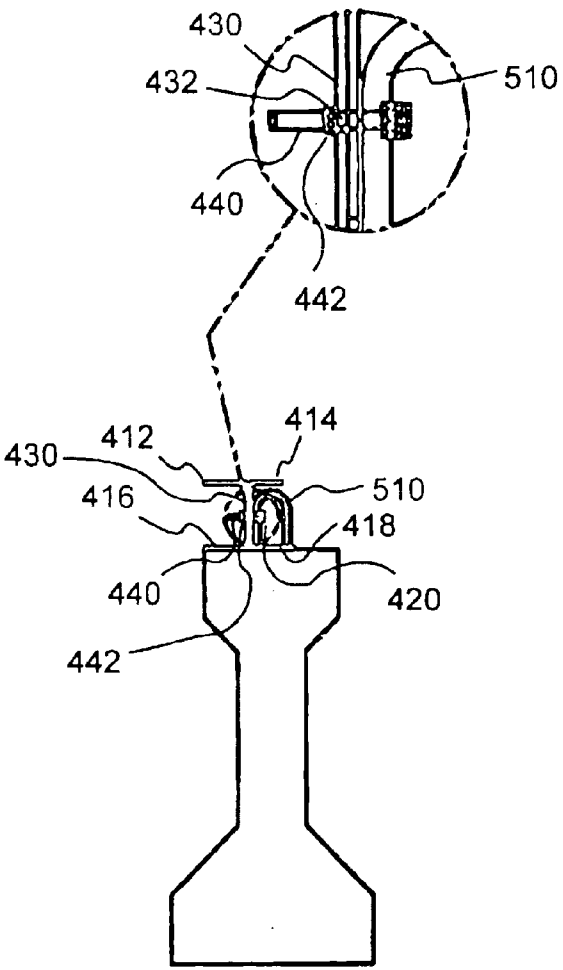
FIG. 4 illustrates a side view of the adapter and reinforced concrete beam of FIG. 3.
Figure 5A:
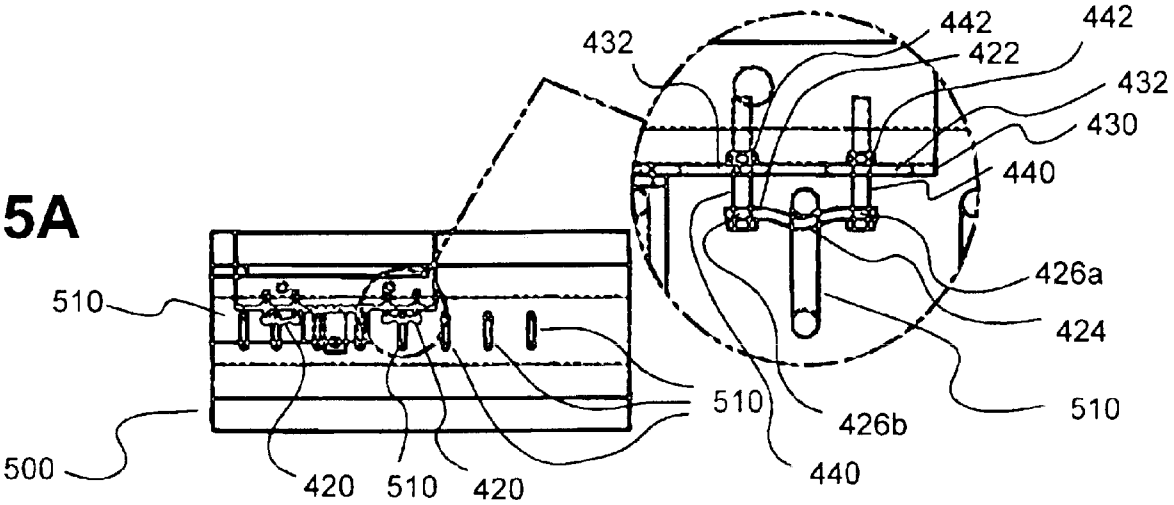
FIG. 5A illustrates a top view of the adapter and reinforce concrete beam of FIG. 3.
Figure 5B:
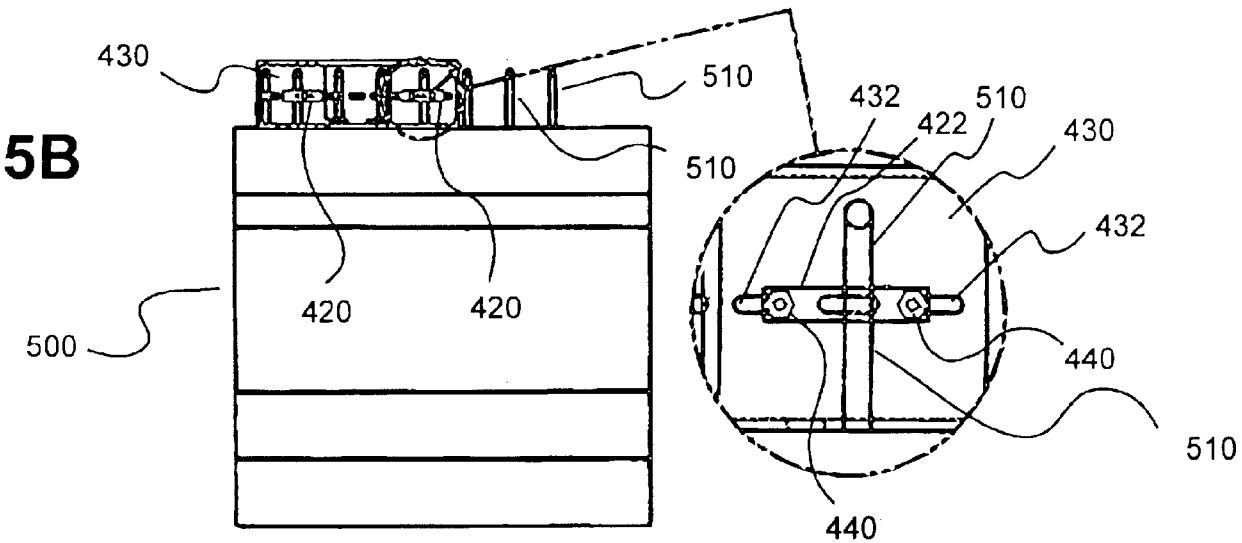
FIG. 5B illustrates a front view of the adapter and reinforced concrete beam of FIG. 3.
Figure 6:
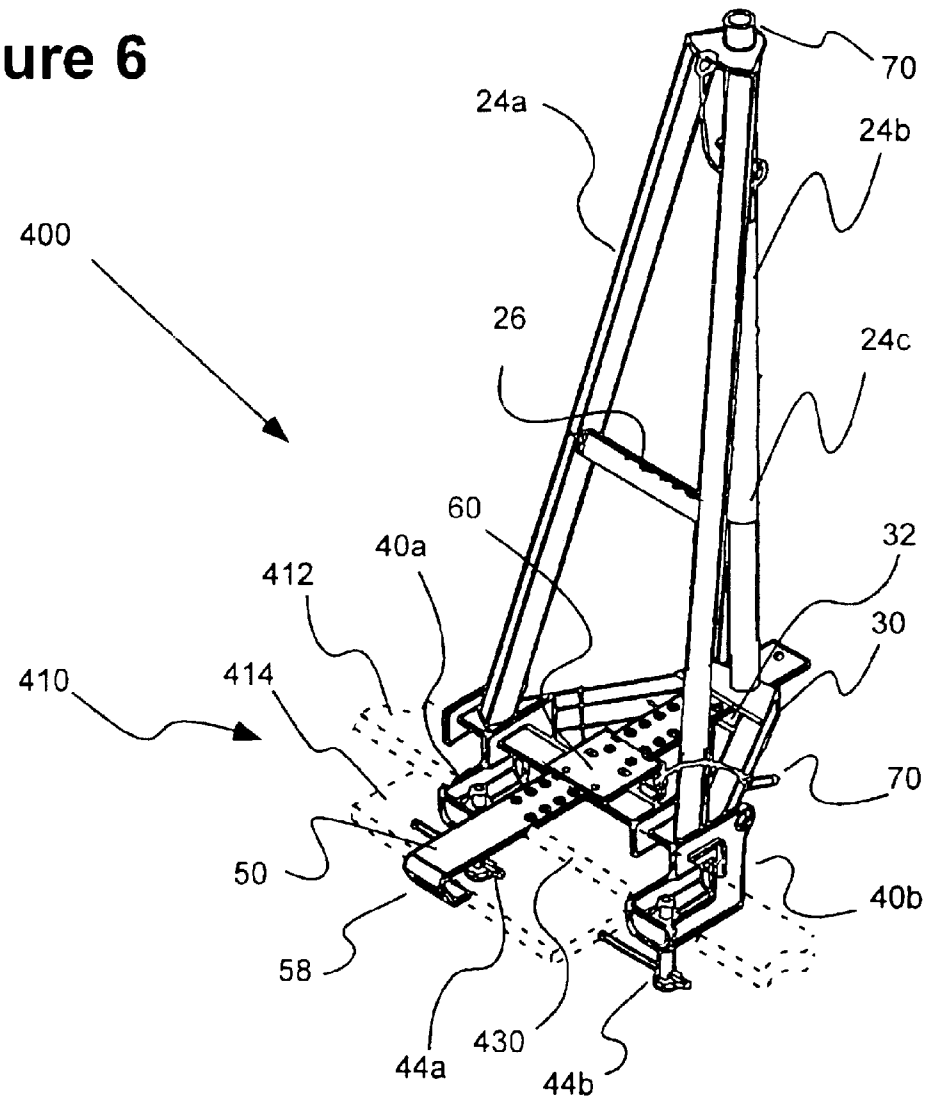
FIG. 6 illustrates a perspective view of the stanchion and adapter system of FIG. 3 in which the stanchion is connected to the adapter.

In the embodiment of FIGS. 3 through 6 (and as best illustrated in FIGS. 4 through 5B) attachment clips 420 include a bracket 422 having a curve section 424 formed therein. Curved section 424 conforms generally to the shape of one of rebars 510. Bracket 422 includes passage 426*a* on one side of curved section 424 and passage 426*b* on another side of curved section 424, through which bolts 440 can pass. Member 430 of adapter 410 can, for example, include passages or slots 432 through which bolts 440 can pass. Attachment clips 420 can be secured with, for example, nuts 442.

Although the present invention has been described in detail in connection with the above examples, it is to be understood that such detail is solely for that purpose and that variations can be made by those skilled in the art without departing from the spirit of the invention except as it may be limited by the following claims.

What is claimed is:

1. A system for anchoring a lifeline for use in fall protection, the system being adapted to anchor to a flange of a flanged I-beam and to a reinforcement bar in concrete, the system comprising: a support member for the lifeline having attached thereto a first connector adapted to attach the support member to the flange of the I-beam, at least one adapter including a second connector adapted to attach the adapter to the reinforcement bar, the adapter including an-adapter anchorage to which the first connector can be attached.

2. The system of claim 1 wherein the first connector is adapted to attach to opposing sides of the flange.

3. The system of claim 2 wherein the first connector includes at least one clamp adapted to attach first side of the flange and an extending member adapted to clasp a second, opposing side of the flange.

4. The system of claim 1 wherein the second connector includes at least one bracket adapted to fasten to the reinforcement bar.

5. The system of claim 4 wherein the second connector includes a plurality of brackets, each of which is adapted to fasten to the reinforcement bar.

6. The system of claim 5 wherein the adapter anchorage includes a first adapter flange extending from a generally vertical member in a first direction and a second adapter flange extending from the generally vertical member in a second direction generally opposite from the first direction.

7. The system of claim 6 wherein the adapter further includes at least a third adapter flange extending from the generally vertical member at an end of the generally vertical member opposite of the first and second adapter flanges.

8. The system of claim 7 wherein the adapter further includes a fourth flange extending from the generally vertical member in a direction generally opposite of the third flange.

9. A system for anchoring a fall protection horizontal lifeline, the system being adapted to anchor to a flange of a flanged I-beam and to a reinforcement bar in concrete, the system comprising: a plurality of support members for the lifeline, each of the support members having attached thereto a first connector adapted to attach the support member to the flange of the I-beam; the system including at least one adapter for each support member, the adapter including a second connector adapted to attach the adapter to the reinforcement bar, the adapter including an adaptor anchorage to which the first connector can be attached.

10. A method of anchoring a fall protection lifeline adapted to be attached to a flange of an I-beam and to a reinforcement bar in concrete, comprising the steps: providing a support member for the lifeline including a first connector adapted to attach the support member to the flange of the I-beam; and providing at least one adapter including a second connector adapted to attach the adapter to the reinforcement bar the adapter including an adaptor anchorage to which the first connector of the support member can be attached.

11. An adapter adapted to anchor a support member for a fall protection lifeline to a reinforcement bar in concrete, wherein the support member has attached thereto a first connector adapted to attach the support member to a flange of an I-beam, the adapter comprising: a second connector to attach the adapter to the reinforcement bar and an adaptor anchorage comprising at least one flange to which the first connector can be attached.

12. The adapter of claim 11 wherein the adapter anchorage includes at least one flange.

13. The adapter of claim 12 wherein the first connector is adapted to attach to opposing sides of the flange.

14. The adapter of claim 13 wherein the first connector includes at least one clamp adapted to attach first side of the flange and an extending member adapted to clasp a second, opposing side of the flange.

15. The adapter of claim 12 wherein the second connector includes at least one bracket adapted to fasten to a reinforcement bar.

16. The adapter of claim 15 wherein the second connector includes a plurality of brackets, each of which is adapted to fasten to the reinforcement bar.

17. The adapter of claim 16 wherein the adapter anchorage includes a first adapter flange extending from a generally vertical member in a first direction and a second adapter flange extending from the generally vertical member in a second direction generally opposite from the first direction.

18. The adapter of claim 17 wherein the adapter further includes at least a third adapter flange extending from the generally vertical member at an end of the generally vertical member opposite of the first and second adapter flanges.

19. The adapter of claim 18 wherein the adapter further includes a fourth flange extending from the generally vertical member in a direction generally opposite of the third flange.

* * * * *